US006471663B1

(12) United States Patent
Van Brunt et al.

(10) Patent No.: US 6,471,663 B1
(45) **Date of Patent: *Oct. 29, 2002**

(54) CHEST COMPRESSION VEST WITH CONNECTING BELT

(75) Inventors: Nicholas P. Van Brunt, White Bear Lake, MN (US); Donald J. Gagne, St. Paul, MN (US)

(73) Assignee: American Biosystems, Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/387,339

(22) Filed: Aug. 31, 1999

(51) Int. Cl.[7] ..... A61H 9/00; A61H 31/00
(52) U.S. Cl. ..... 601/41; 601/44; 601/152
(58) Field of Search ..... 601/41–44, 148, 601/149, 151, 152; 128/DIG. 20

(56) References Cited

U.S. PATENT DOCUMENTS 4,397,306 A 8/1983 Weisfeldt et al.
4,413,357 A * 11/1983 Sacks ..... 2/2.5
4,753,226 A * 6/1988 Zheng et al. ..... 601/150
4,838,263 A 6/1989 Warwick et al.
4,977,889 A 12/1990 Budd
5,056,505 A 10/1991 Warwick et al.
5,437,615 A * 8/1995 Pekar et al. ..... 602/19
5,455,159 A 10/1995 Mulshine et al. ..... 435/7.23
5,891,062 A 4/1999 Schock et al. ..... 601/41

* cited by examiner

*Primary Examiner*—Danton D. DeMille
(74) *Attorney, Agent, or Firm*—Kinney & Lange, P.A.

(57) ABSTRACT

A pneumatic chest compression vest is disclosed for the purposes of clearing the lungs of mucus and producing quality sputum samples for analysis. The vest is comprised of a belt and a front panel which has an air bladder that applies a compressive force to the region of the chest that encompasses the lungs mounted on its inner surface. The belt extends around a patient to hold the vest in the correct position during treatment.

15 Claims, 5 Drawing Sheets

CHEST COMPRESSION VEST WITH CONNECTING BELT

CROSS-REFERENCE TO RELATED APPLICATION(S)

This application is related to "Chest Compression Vest with Front Panel Bib" and "Method and Apparatus for Inducing Sputum Samples for Diagnostic Evaluation", which were filed on the same day and also assigned to American Biosystems.

BACKGROUND OF THE INVENTION

The present invention relates to chest compression devices and in particular to a high frequency chest wall oscillator device.

Manual percussion techniques of chest physiotherapy have been used for a variety of diseases such as cystic fibrosis emphysema, asthma, and chronic bronchitis, to remove the excess mucus that collects in the lungs. To bypass dependency on a care giver to provide this therapy, chest compression devices have been developed to produce high frequency chest wall oscillation (HFCWO), the most successful method of airway clearance. In addition, these devices can be utilized for induction of high quality sputum samples for screening and diagnosing a number of pulmonary disorders such as lung cancer, asthma, chronic obstructive pulmonary disease (COPD), tuberculosis, *Pneumocystis carinii* pneumonia (PCP), inflammation, and infection.

The device most widely used to produce HFCWO is the ABI Vest Airway Clearance System by American Biosystems, the assignee of the present application. A description of the pneumatically driven system can be found in the Van Brunt et al. patent, U.S. Pat. No. 5,769,797, which is assigned to American Biosystems, Inc. Another pneumatic chest compression device has been described by Warwick et al., U.S. Pat. No. 4,838,263.

Pneumatically driven HFCWO produces substantial transient increases in the airflow velocity with a small displacement of the chest cavity volume. This action produces a cough-like shear force and reduction in mucus viscosity that results in an upward motion of the mucus.

A shortcoming of the design of the vests used by these devices is that the compressions are not concentrated on the region of the chest which directly surrounds the lungs. An inflatable air bladder that provides the compressive force extends all the way around the patient including the back. The bladder has a rather large volume which renders it inadequate to create the magnitude of force necessary on regions encompassing the lungs to induce deep sputum that, for example, provides optimal samples for lung cancer screening. In addition, since the vests close in the front, the air bladder is not continuous over the chest. The air bladder's design does not allow it to reach to the highest lobes of the lung, and it extends too low resulting in compression on the stomach, a particular problem for short adults and children. This results in inefficient and insufficient mucus induction and mobilization. Thus, there remains a need to design a vest which focuses the force in the proper regions to give optimal results.

Prior art vests, when fastened to the patient and not inflated, take on the shape of the torso. When inflated they bow outward. The outer material is not rigid enough to maintain its shape, and so the vest takes on a more circular shape. The outward force, which causes the bowing, increases the volume of the air bladder, but it is more desirable to have the increase in volume result from a change in the shape of the chest. Therefore, a vest which maintained its shape would be more efficient, because the outward force that causes the vest to change shape would not cancel out the inward compressive force.

The previous vests were designed for one person to use multiple times. The durable material that is used makes the vest too expensive to be utilized for a single use and cannot be easily and cleanly burned for disposal. For analysis of sputum samples, though, generality the patient only needs the vest one time. The vests, however, cannot be used by multiple patients, because mucus is expelled onto the vest by each patient, and the vests cannot be sterlized between uses. Therefore, there is also a need for a vest which is cost effective for single-use.

BRIEF SUMMARY OF THE INVENTION

The present invention is a pneumatic chest compression vest which loosens and helps remove mucus from a person's lungs or induces production of sputum samples for further diagnostic analysis. The vest is designed to focus the compressive force on the region of the chest which encompasses the lungs.

The vest includes a front panel having a central bib portion and side portions. An air bladder is mounted to the inner surface of the front panel. Air ports and removable air couplings on the front panel are in communication with the air bladder. When inflated, the air bladder applies a compressive force focused on the region of the chest which encases the lungs.

The vest also includes a belt that connects to the front panel and extends around the person and across the outer surface of the front panel. The belt contains a plurality of longitudinally spaced holes which align with the air ports on the front panel. The air couplings extend through the holes in the belt and the air ports to secure the vest and connect the air bladder to a source of oscillating pneumatic pressure.

DETAILED DESCRIPTION

Figure 1:
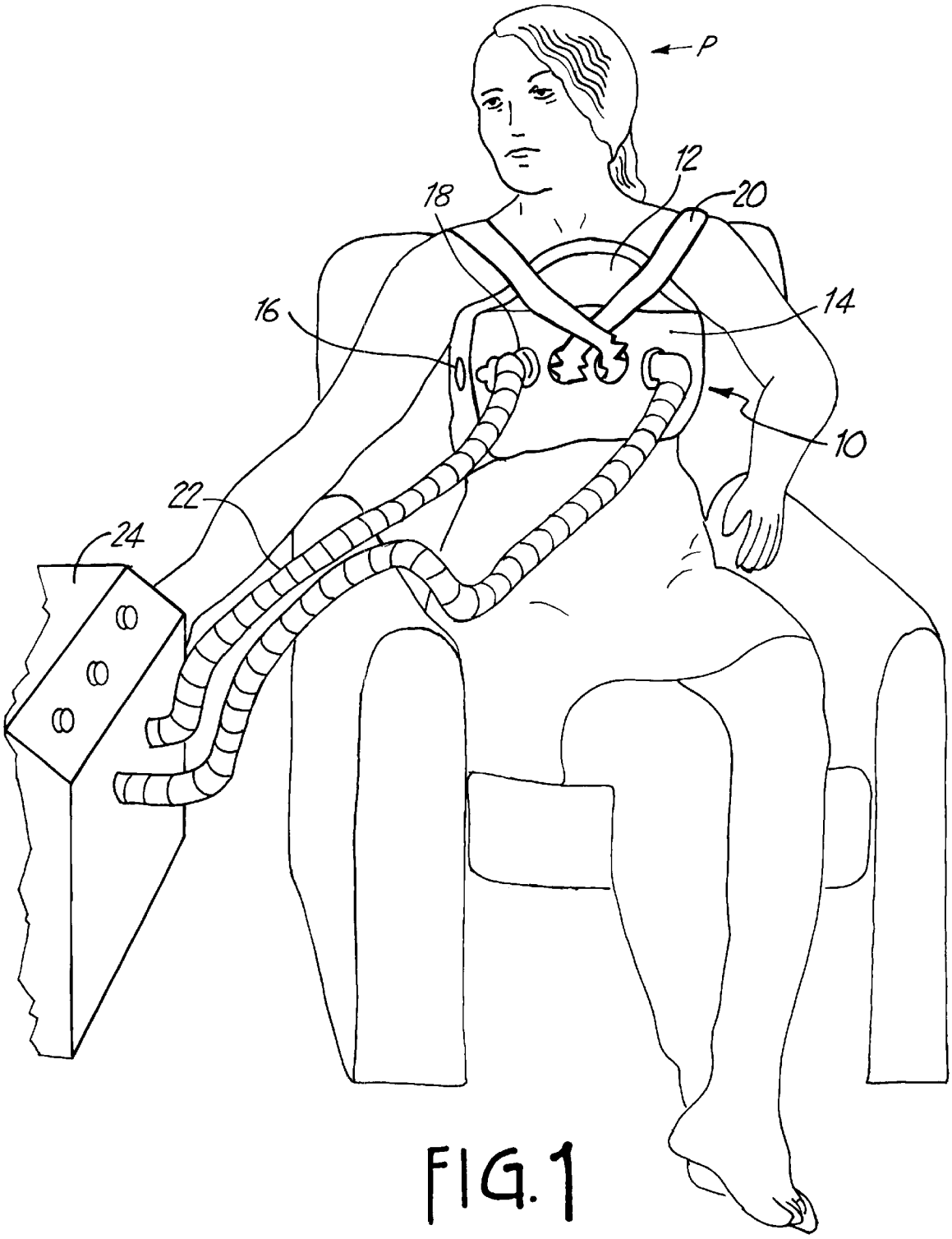
FIG. 1 shows a person wearing a pneumatic chest compression vest.

FIG. 1 shows pneumatic chest compression vest 10 of the present invention fitted onto patient P. Pneumatic chest compression vest 10 is shown with front panel 12, belt 14 with belt holes 16, air couplings 18, suspenders 20, hoses 22, and pneumatic pressure generator 24. Front panel 12 of pneumatic chest compression vest 10 covers from approximately the bottom of the patient's rib cage to near the patient's collar bone and extends over the front of the patient's chest to under the patient's arms. Belt 14, which is attached to one side of front panel 12, wraps around the patient's back and across front panel 12. Pneumatic chest compression vest 10 is secured by aligning belt holes 16 with air ports (not shown) on front panel 12 so that air couplings 18 can insert through belt holes 16 and the air ports. Suspenders 20 are also attached to secure pneumatic chest compression vest 10 in place. One end of hoses 22 attaches to air couplings 18 and the other end attaches to pneumatic pressure generator 24. Pneumatic pressure generator 24 provides the oscillating pressure to vest 10 to apply compressive force to the patient's chest. Pneumatic chest compression vest 10 and its operation will be described in more detail in subsequent figures.

Figure 2:
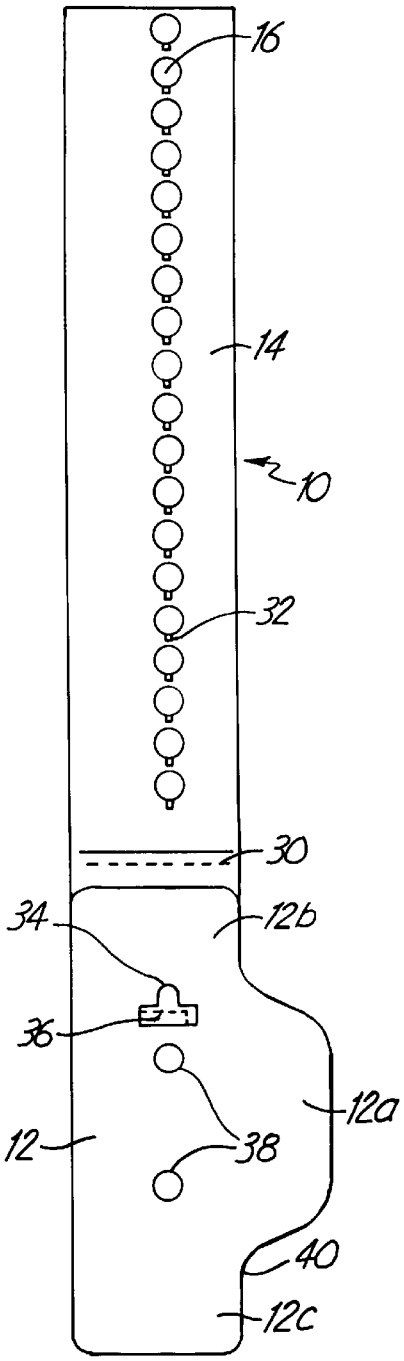
FIG. 2 is a front view of a pneumatic chest compression vest.

FIG. 2 is a front view of pneumatic chest compression vest 10 laid flat. Front panel 12 is comprised of central bib portion 12*a*, side portions 12*b* and 12*c*, tab 34, tab seams 36, air ports 38, and liner seam 40. Belt 14, which attaches to front panel 12 at belt seam 30, contains belt holes 16 with slits 32.

Pneumatic chest compression vest 10 wraps around the torso of patient P. Belt 14 of pneumatic chest compression vest 10 extends around the back of patient P and across the outer surface of front panel 12. Belt 14 contains longitudinally positioned belt holes 16 each of which includes a slit 32. Tab 34 is welded onto front panel 12 at tab seams 36 and inserts into one of the belt holes 16.

Pneumatic chest compression vest 10 is secured in place by overlapping belt holes 16 with air ports 38 on front panel 12. The distance between air ports 38 corresponds to a multiple of the distance between each belt hole 16. In a preferred embodiment, the diameter of belt holes 16 and air ports 38 is about 1.4 inches with belt holes 16 centered about 2 inches apart, and air ports 38 are centered about 6 inches apart. Tab 34 is welded to front panel 12 at tab seams 36 so that it aligns with air ports 38 on front panel 12 in such a way that as belt 14 wraps around patient P and extends across the outer surface of front panel 12, tab 34 can insert into a belt hole 16. When tab 34 is inserted into a belt hole 16, corresponding belt holes 16 will align with air ports 38. Once aligned, air couplings 18 can easily be snapped into belt holes 16 and air ports 38 (see FIG. 1). Depending on the circumference of the patient's torso, different belt holes 16 will align with tab 34 and air ports 38. This allows adjustment of pneumatic chest compression vest 10 so that it fits securely around patient P.

Slits 32 are preferably about 0.2 inch long. Slits 32 allow ease of insertion of suspenders 20 into belt holes 16 (see FIG. 1).

Liner seam 40 extends along the perimeter of front panel 12 encompassing central bib portion 12*a*, which has a preferred height of about 11.75 inches but can be from about 9.0 to about 13.0 inches, and side portions 12*b* and 12*c*, which have a preferred height of about 7.75 inches but can be from about 6.0 to about 9.0 inches.

Figure 3:
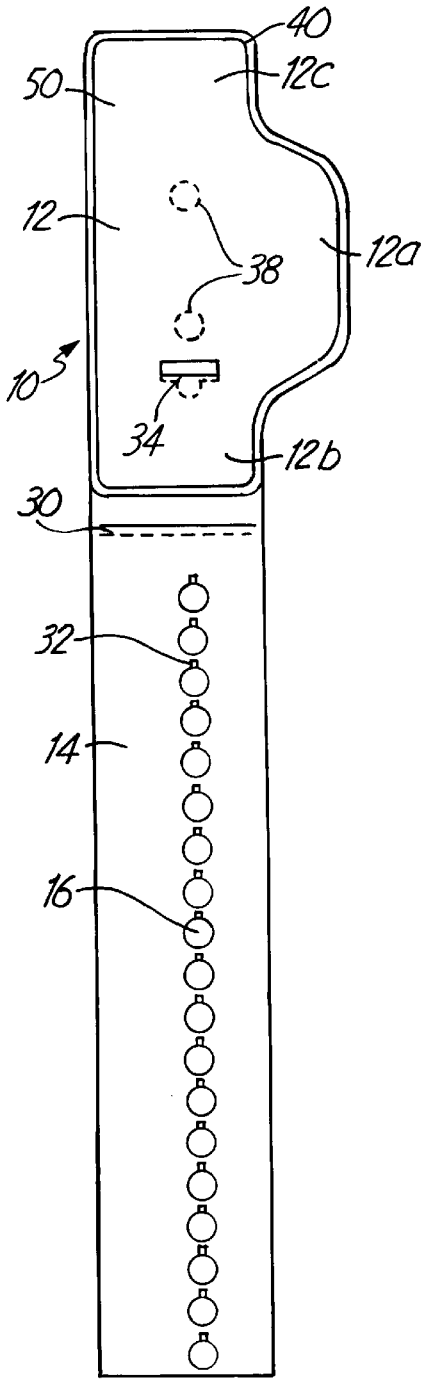
FIG. 3 is a back view of a pneumatic chest compression vest.

FIG. 3 is a back view of pneumatic chest compression vest 10 laid flat. Front panel 12 includes central bib portion 12*a*, side portions 12*b* and 12*c*, air ports 38 (in phantom), and liner seam 40. A liner 50 is shown welded to the inner surface of front panel 12 along liner seam 40. Belt 14, belt holes 16 with slits 32, belt seam 30, and tab 34 (in phantom) are shown and were described in FIG. 2.

Liner 50 is preferably made of an elastic material such as 4 mil polyethylene, and the remaining parts, except air couplings 18, are made of an inelastic material such as 8 mil polycarbonate. These materials are relatively inexpensive and can be easily incinerated, producing no toxic emissions and little particulate matter for disposal. Liner 50 mounted onto front panel 12 defines an air bladder which is preferably about 21 inches wide.

In operation, the air bladder is inflated via air ports 38 against the chest of patient P to apply a compressive force to the patient's lungs. Side portions 12*b* and 12*c* allow the air bladder to extend under the arms of patient P. Thus, the air bladder also compresses the sides of the torso which cover the patient's lungs. Since the air bladder does not extend along belt 14, the compressive force is focused on the proper region for optimal treatment. The combination of a generally rigid outer surface and flexible bladder prevents the vest from taking on a circular shape when the air bladder is inflated. Instead, inflating the air bladder forces the chest to change shape so that most of the motion during compression is inward, and the outward force is minimized. This increases the efficiency of the system. The volume of the air bladder is also reduced over the prior art vests, which makes the system more efficient in terms of applying the same volume of air over a smaller surface area so that the magnitude of force necessary for deep sputum induction is achieved.

Pneumatic chest compression vest 10 is suitable for typical pressure requirements of about 0.5 to about 1.0 P.S.I., and can operate for about 30 to about 45 minutes during an oscillatory chest compression treatment. It may last longer for other less stringent applications.

Figure 4:
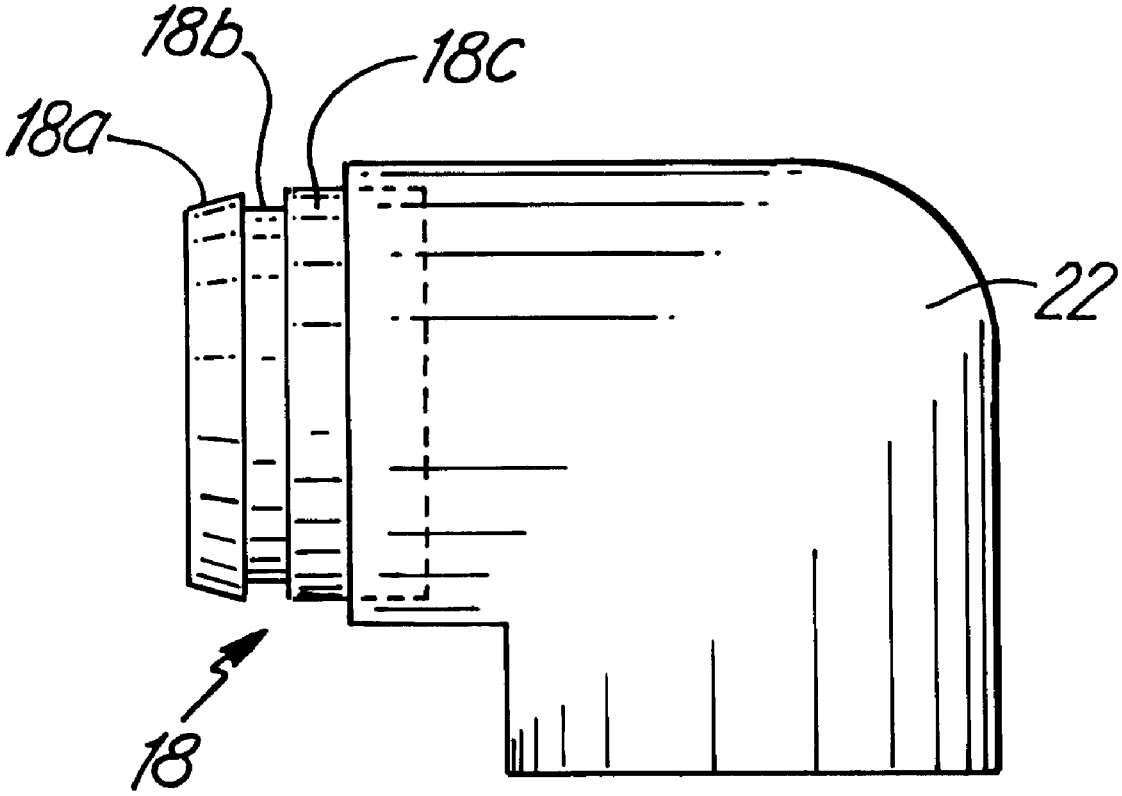
FIG. 4 is a side view of an air coupling connected to a hose.

FIG. 4 shows a side view of air coupling 18 connected to hose 22. Air coupling 18 includes head 18*a*, neck 18*b*, and body 18*c* (shown partially in phantom). A portion of hose 22 is shown partially enclosing body 18*c* of air coupling 18.

In a preferred embodiment, air coupling 18 is made of aluminum with a height of about 3.25 inches. The height of head 18*a* is about 0.85 inches, neck 18*b* is about 0.75 inches, and body 18*c* is about 1.65 inches and is removably attached to neck 18*b*. Also, hose 22 is angled about 90° at the end that connects to air coupling 18.

Head 18*a* is beveled with the diameter increasing from about 1.30 inches to about 1.40 inches. The inside diameter of head 18*a* is about 1.15 inches. Neck 18*b* has a diameter of about 1.36 inches. Body 18*c* has a diameter of about 1.50 inches with an inside diameter of about 1.20 inches. The inside diameter of air coupling 18 increases from head 18*a* to body 18*c*.

The operation of air coupling 18 is discussed in reference to parts of pneumatic chest compression vest 10 that are not shown. Head 18*a* snaps through belt holes 16 and air ports 38 into the air bladder. Neck 18*b* remains within front panel 12 and belt 14 to secure pneumatic chest compression vest 10 around patient P. Hose 22 connects to and partially overlaps body 18*c*, which is not connected to neck 18*b* at this point. Body 18*c*, when connected to neck 18*b*, remains on the external side of pneumatic chest compression vest 10. Thus, air coupling 18 has dual functions—to secure pneumatic chest compression vest 10 and provide a coupling to attach hose 22. With hose 22 essentially hanging parallel to front panel 12, hose 22 hangs in a manner which keeps air coupling 18 from pulling outward on pneumatic chest compression vest 10. This type of system reduces the parts needed to operate the vest, which makes it less expensive to manufacture and, therefore, ideal for a disposable vest system.

Figure 5:
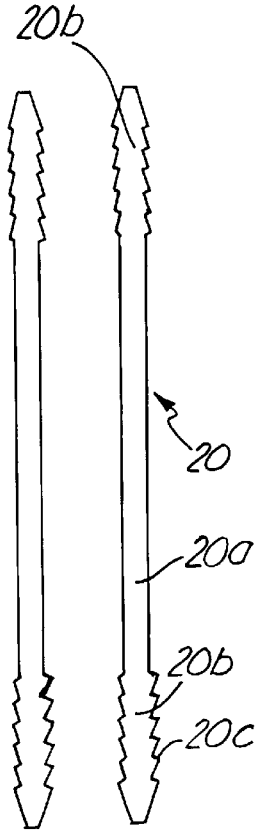
FIG. 5 is a top view of a suspender.

FIG. 5 shows suspender 20 laid flat. Suspender 20 is comprised of strap 20*a* and serrated ends 20*b* which include serrations 20*c*.

In a preferred embodiment, the length of suspender 20 is about 35.0 inches. Serrated ends 20*b* are about 7 inches long, and each includes about 6 approximately 1 inch long serrations 20*c*. Strap 20*a* has a width of about 1.1 inches. Serrations 20*c* extend out to about 1.6 inches.

In operation, suspenders 20 extend from the front to the back of pneumatic chest compression vest 10 and insert into two of the belt holes 16 on the front and another pair of belt holes 16 in the back. Serrations 20*c* allow suspenders 20 to be adjusted to the proper length for a secure fit. In a preferred embodiment, suspenders 20 are crossed in front of patient P to minimize movement or slippage of pneumatic chest compression vest 10 during treatment (see FIG. 1).

Figure 6:
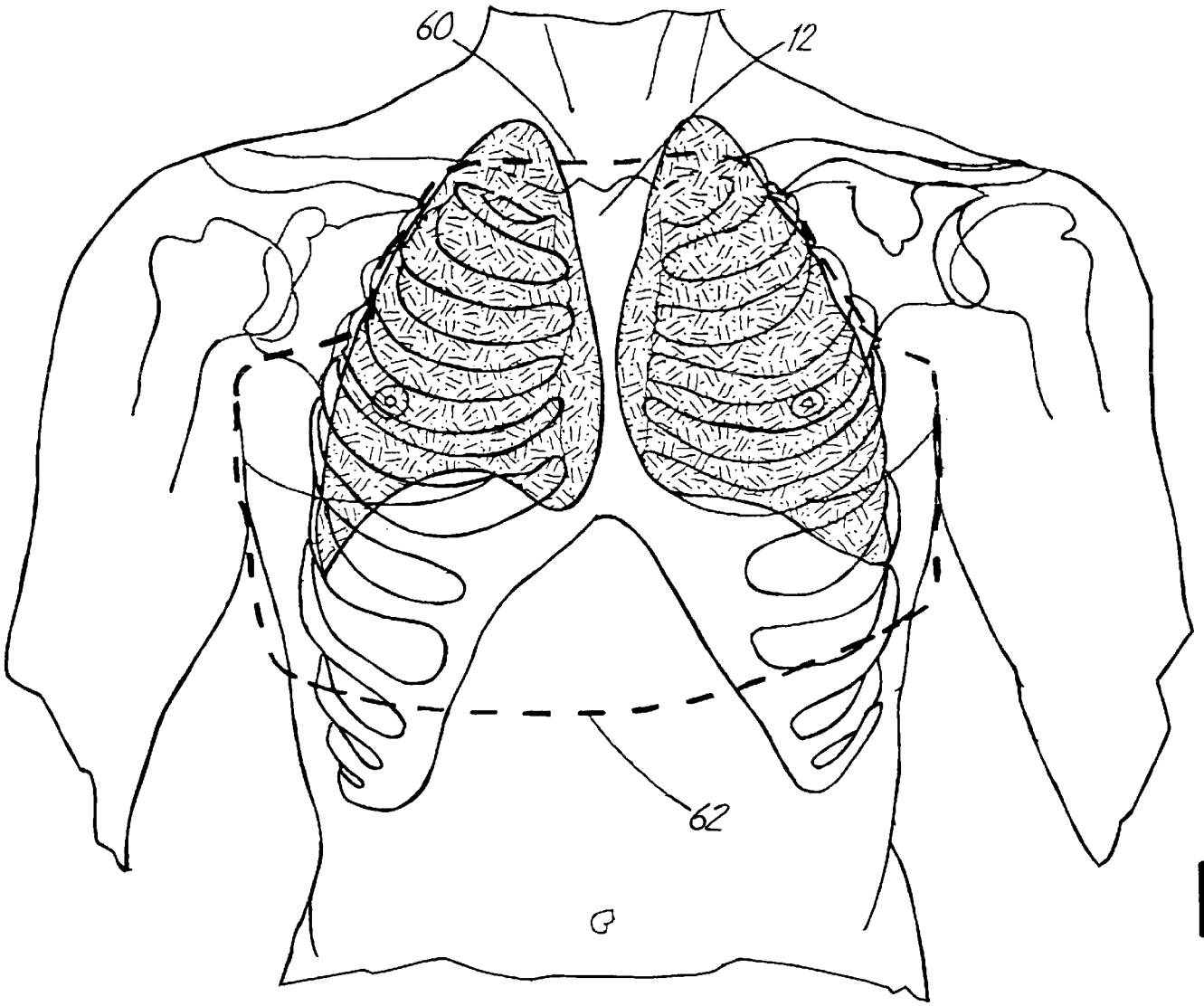
FIG. 6 shows where a person's lungs are located relative to a pneumatic chest compression vest.

FIG. 6 illustrates how pneumatic chest compression vest 10 is positioned with respect to the patient's lungs and skeletal structure. An outline of front panel 12 with top edge 60 and bottom edge 62 of pneumatic chest compression vest 10 indicates the region of the patient's chest that is covered.

In operation, front panel 12 preferably covers the region of the torso which encases the lungs of patient P. Top edge 60 is positioned near the patient's collar bone, and bottom edge 62 is positioned near the bottom of the patient's rib cage. This provides a focused compressive force on the lungs with the necessary magnitude to induce deep sputum. Compression on the stomach is minimized, and top edge 60 reaches up to the upper lobes of the lungs to facilitate mucus removal in the upper lobes. Thus, the improved design increases the efficiency of the system to obtain sufficient sputum induction and mucus mobilization.

Figure 7:
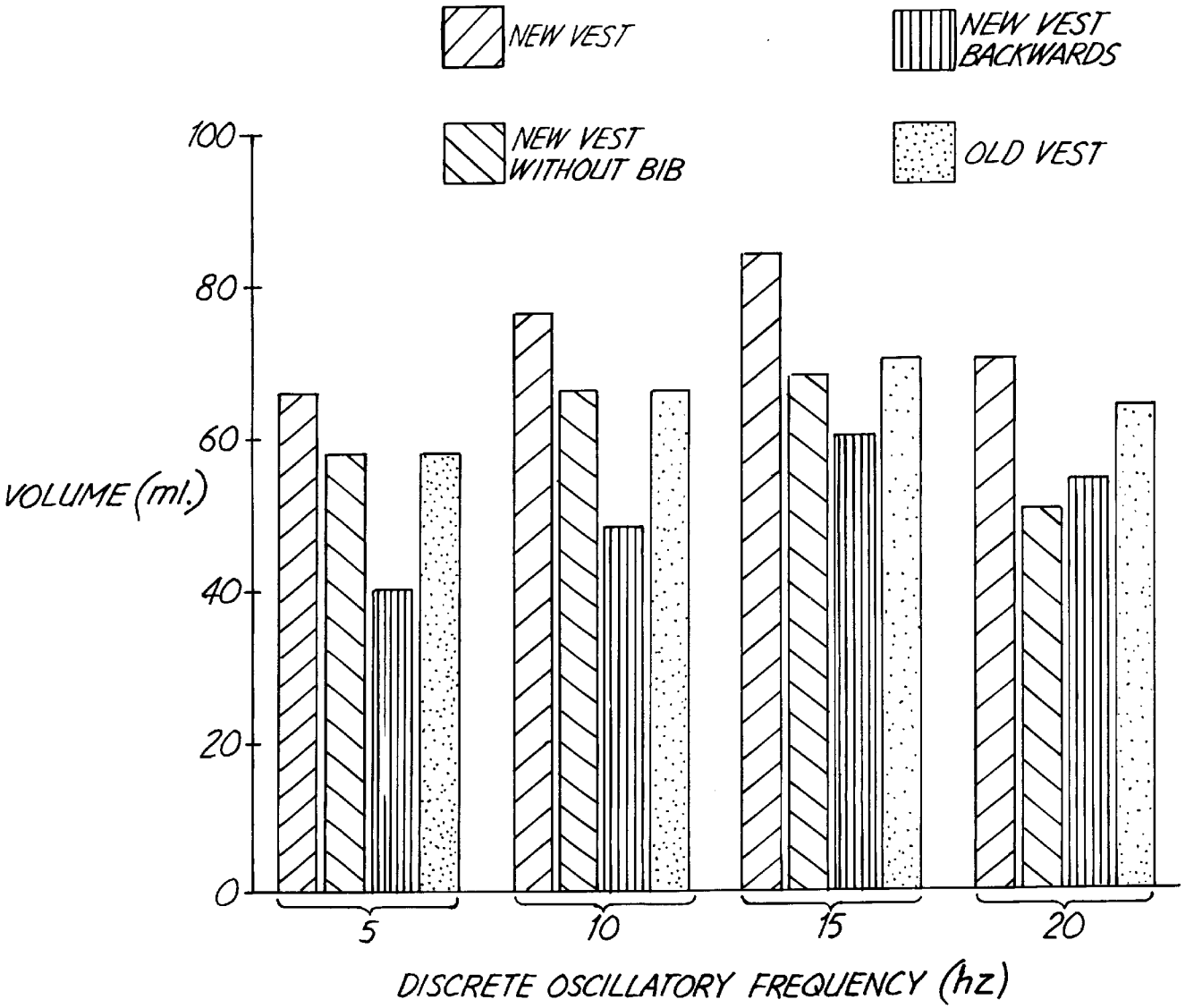
FIG. 7 is a graph illustrating the enhanced performance of a pneumatic chest compression vest in the preferred position.

FIG. 7 shows the results of a comparison done between the present invention (new vest), the present invention without the bib section of central bib portion 12*a* (new vest w/o bib), the present invention positioned backwards (new vest backwards), and a prior art vest (old vest). FIGS. 2 and 3 provide a good view of the bib section of central bib portion 12*a*. The bib section is the part of front panel 12 that compresses the upper lobes of the lungs. Peak expiratory volume (peak volume) was measured on a single subject with each variation over an oscillatory frequency range between 5 and 20 Hertz. The subject was fitted with a vest and given a mouthpiece with a hose attached to a volume chamber. The volume chamber was equipped with a sensor that measured changes in oscillatory volume. Expiratory volumes were measured with each vest variation tested at 5, 10, 15, and 20 Hertz. The graph illustrates that the present invention in the preferred position (with the front panel over the patient's chest and the bib portion extending to about the collar bone) produces the highest peak volume of airflow. The high peak volume of airflow corresponds to an increased force asserted on the mucus which results in increased mobilization. This data supports the conclusion that the new vest is superior over prior art.

Pneumatic chest compression vest 10 is designed more efficiently to provide effective sputum induction for diagnostic evaluation and mucus mobilization for therapeutic lung clearance. The compressions are focused on all lobes of the patient's lungs with a force that induces deep sputum production and facilitates better lung clearance. The combination of a rigid outer surface and flexible bladder results in more efficiency in that outward forces that change the shape of the vest and cancel inward compressive forces on the chest are minimized. Pneumatic chest compression vest 10 can be composed of materials that satisfy this need and are also relatively inexpensive, and make the vest easy and safe to dispose of. The resulting vest is efficient and cost-effective for single-use.

Although the present invention has been described with reference to preferred embodiments, workers skilled in the art will recognize that changes may be made in form and detail without departing from the spirit and scope of the invention.

What is claimed is:

1. A pneumatic chest compression vest comprising:

a front panel with an inner and outer surface and a first air port;

an air bladder which is in communication with the first air port;

a belt which is connected to one end of the front panel, is long enough to wrap around sides and back of a patient and across the outer surface of the front panel, and has a plurality of longitudinally spaced belt holes, the plurality of belt holes being greater in number than the number of air ports; and a first air coupling which extends through one of the belt holes and the first air port to hold the belt in position and to connect the air bladder to a source of oscillating pneumatic pressure a tab on the front panel that is insertable into one of the belt holes to assist in aligning one of the belt holes with the first air port.

2. The vest of claim 1 and further comprising:

a second air port on the front panel in communication with the air bladder; and a second air coupling which extends through another one of the belt holes and the second air port to hold the belt in position and to connect the air bladder to the source of oscillating pneumatic pressure.

3. The vest of claim 1 and further comprising:

a tab on the front panel that is insertable into one of the belt holes to assist in aligning one of the belt holes with the first air port.

4. The vest of claim 1 and further comprising:

a pair of suspenders that extend from belt holes positioned in front of the front panel to belt holes spaced from the front panel.

5. The vest of claim 4 wherein the suspenders are crossed in the front.

6. The vest of claim 1 wherein the belt holes have slits.

7. The vest of claim 1 wherein the belt is made of an inelastic material.

8. The vest of claim 1 wherein the belt is made of a material which produces no toxic emissions when burned and little particulate matter.

9. The vest of claim 1 wherein a height of the belt is between about 6.0 to 9.0 inches.

10. The vest of claim 1 wherein a length of the belt is about 36 inches.

11. The vest of claim 1 wherein the front panel and belt are made of 8 mil polycarbonate.

12. A method of securing a pneumatic chest compression vest, the method comprising:

positioning a front panel of the vest over a patient's chest, the front panel carrying an inflatable bladder;

wrapping a belt around the patient's back and across the front panel;

aligning a belt hole with an air port in the front panel; and inserting an air coupling through the aligned belt hole and air port.

13. The method of claim 12 and further comprising:

inserting a tab on the front panel into one of a plurality of belt holes to assist in aligning the belt hole with the air port.

14. The method of claim 12 and further comprising:

attaching a pair of suspenders from a pair of belt holes in the front of the front panel to a pair of belt holes near the back.

15. The method of claim 14 wherein the suspenders are crossed in the front of the patient.

* * * * *